United States Patent [19]

Patel et al.

[11] 4,048,024

[45] Sept. 13, 1977

[54] BRIGHT LEVELLING ZINC PLATING

[75] Inventors: Direj Vallabhbhai Patel, South Harrow; John Joseph Bernard Ward, Wantage, both of England

[73] Assignee: International Lead Zinc Research Organization, Inc., New York, N.Y.

[21] Appl. No.: 669,276

[22] Filed: Mar. 22, 1976

[30] Foreign Application Priority Data

Mar. 27, 1975 United Kingdom ..... 13052/75

[51] Int. Cl.[2] ..... C25D 3/22

[52] U.S. Cl. ..... 204/55 R; 204/43 Z

[58] Field of Search ..... 204/55 R, 55 Y, 43 Z, 204/44, 123, 114

[56] References Cited

U.S. PATENT DOCUMENTS

| | | | |
|---|---|---|---|
| 2,799,635 | 7/1957 | Chester et al. | 204/55 R |
| 3,833,486 | 9/1974 | Nobel et al. | 204/55 R X |

OTHER PUBLICATIONS

Herb Geduld, Metal Finishing, pp. 27–31, Mar. 1976.

W. George Parks et al., The Electrochemical Soc., Preprint 69–14, (1936).

*Primary Examiner*—G. L. Kaplan

*Attorney, Agent, or Firm*—Brumbaugh, Graves, Donohue & Raymond

[57] ABSTRACT

Levelling agents for use in zinc electroplating solutions are described comprising thallous ions or a combination of peptone and thiourea. The thallous ions are preferably added to a concentration of at least 1 mg/l and the peptone-thiourea combination added to a concentration of at least 100 mg/l peptone and 50 mg/l thiourea.

15 Claims, No Drawings

BRIGHT LEVELLING ZINC PLATING

Coatings of zinc can be applied to metallic articles by electrodeposition, and are finding increasing use both as protective coatings in their own right and as substrates for chromium electrodeposition. Conventional decorative finishing for diecastings is based on a multi-coat plating system. Generally 8–20 μm copper, 20–35 μm nickel and 0.25–125 μm chromium are applied successively to the polished base metal. The total cost of finishing a diecasting in this way may amount to 50–70% of the overall conversion cost from the metal. Substitution of a cheaper alternative to copper and nickel undercoats which would also require less polishing before plating would substantially reduce the cost of the finished diecasting thus maintaining their competitiveness against plated plastics or alternative materials.

Work on the development of trivalent chromium plating baths revealed that such baths were capable of depositing bright and adherent chromium deposits directly onto polished zinc diecastings. Diecastings finished in this way and with as little as 1 μm chromium deposit exhibited unexpectedly good corrosion resistance to a severely polluted environment.

A shortcoming of direct chromium plating however is that it is not possible to polish a diecasting economically to a sufficient standard to produce a direct chromium plated finish indistinguishable from a conventionally finished article. In order to obtain bright or decorative chromium plate, it is necessary that the substrate be substantially level. This invention provides a solution and electrodeposition method of producing substantially level zinc coatings on metallic articles by the use of one or more levelling agents in the solution.

The invention provides an aqueous solution for electroplating zinc, which solution is preferably at a pH of 3 to 6 and comprises:

a. zinc ions preferably at a concentration of 0.2 to 3.0 M, and b. as a levelling agent, thallous ions preferably at a concentration of at least 1 mg/l, and/or a peptone at a preferred concentration of at least 100 mg/l together with a thiourea at a preferred concentration of at least 50 mg/l.

Apart from the levelling agents, the zinc electroplating solutions with which this invention is concerned are conventional. The zinc may be present for example as sulphate, fluoborate or halide. Preferred solutions are:

a. sulphate based, for example
   - zinc sulphate (0.2 to 3.0 M, preferably from 0.5 M to 1.2 M).
   - zinc chloride (10 g/l to 50 g/l, preferably 25 g/l) (to avoid anode passivation).
   - boric acid (10 g/l to 50 g/l, preferably 25 g/l) (to buffer the solution and broaden the plating range), or b. chloride based, for example
   - zinc chloride (0.1 to 2.0 M, preferably 160 g/l)
   - ammonium chloride (1 to 3 M, preferably 100 g/l) (to improve solution conductivity)
   - boric acid (10 g/l to 30 g/l, preferably 20 g/l) (to buffer the solution and broaden the plating range).

Solutions of ammonium salts give rise to effluent problems, and on this account sulphate solutions are preferred. The pH of the solution should be from 3 to 6, and is preferably from 4 to 5. At low pH there is a loss of plating efficiency. At high pH basic zinc salts tend to precipitate. The pH may be adjusted by controlled addition of sulphuric acid, zinc oxide or potassium hydroxide. In solutions in which zinc is stabilized at alkaline pH by means of cyanide or other materials, the levelling agents according to the invention are less effective. Also, the zinc plating solutions of this invention may contain other conventional additives, such as brightening agents.

Potassium salts, particularly potassium chloride, may be used as agents to improve the conductivity of sulphate based solutions. The preferred ranges of potassium salts are 0.1 M to 1.5 M potassium ion, optimally 0.25 M to 1.0 M. The chloride ion content of the bath, hitherto added as zinc chloride, can be conveniently added as the potassium salt which is additionally advantageous in that potassium chloride is cheaper than zinc chloride and may be obtained in a purer form.

Levelling performance has long been known as an important property of any plating solution. It is generally defined, with reference to a substrate which is flat apart from a groove 25 micrometers deep and 25 micrometers across which has been electroplated with the solution in question to an average thickness of 25 micrometers, by Nakamura's formula:

$$\% \text{ levelling} = \frac{100.\, d_1}{d_2 + d_3}$$

$d_1$ is the thickness of the plate above the bottom of the groove, $d_2$ is the deposit thickness at the peak (on either side of the groove), and $d_3$ is the depth of the groove (25 microns).

Preferred zinc plating solutions according to this invention achieve at least 70% levelling when plated at current densities from 50 to 1200 A/m², particularly 100 to 900 A/m², and at least 90% levelling when plated at preferred current densities of from 100 to 900 A/m².

Levelling agents are believed to act by being deposited on peaks and ridges of the cathode, rather than in holes and valleys, and there generating an overvoltage which inhibits subsequent metal (e.g. zinc) deposition. This overvoltage increases with increasing current density. The metal is therefore preferentially deposited on areas, e.g. holes and valleys, of the cathode where the current density is low, giving rise to an electrodeposited coating which is flatter on a micrometer scale than the uncoated cathode. The degree of levelling depends partly on the thickness of the electrodeposited layer.

The levelling agent is co-deposited with the metal, and its concentration in the plating bath needs to be replenished from time to time in prolonged operation. The use of excess levelling agent can give rise to the undesirable effect that holes and valleys in the cathode correspond to peaks and ridges in the coating. In addition to being expensive, the use of excess levelling agent can therefore be detrimental.

One feature of this invention arises from the discovery that thallous ions are effective levelling agents for zinc plating solutions. The concentration should be at least 1 mg/l to achieve a significant effect, and is preferably from 2 to 10 mg/l. Concentrations of more than 1 mg/l can have levelling power greater than 100%. Such excessively levelling electrolytes are not preferred. It was not expected that thallous ions at this very low concentration would have any observable levelling action on zinc electrodeposits. Thallium is co-deposited with zinc, particularly at high current densities, and is thus consumed from, and needs to be replenished in, the plating bath.

Another feature of this invention arises from the discovery that peptones and thioureas are effective in combination as levelling agents for zinc plating solutions. This discovery is surprising since neither peptone nor thiourea alone is capable of significantly levelling zinc electrodeposits. It is believed that the peptone is the primary levelling agent, and that the thiourea in some way regulates adsorption of the peptone.

Peptone is described as a light yellowish-brown water soluble powder or granules with a meat-like but not putrid odor, made by the peptic or tryptic digestion of fibrin or other proteins such as lean beef or casein. It is preferred that pure food grade peptone free of gelatinous material be used in conjunction with the present invention. While alternatives have not yet been found, it is anticipated that other similar materials of biological origin may have similar properties in zinc plating solutions.

It is possible to use, instead of thiourea itself, a substituted thiourea such as N-phenyl thiourea but such substituted thioureas have no advantage over the unsubstituted compound and are much more expensive and less readily available so that their use is not preferred.

From 0.2 to 2 g/l, optimally 0.5 g/l, of peptone, and from 0.1 to 1.0 g/l, optimally 0.25 g/l, of the thiourea are preferred, such that the weight ratio of peptone to thiourea is from 1:1 to 5:1, optimally 2:1.

The levelling characteristics of the solution of this invention, particularly those in which the anion is predominantly chloride, may be enhanced by aging, for example, a few hours. Similar aging effects have been observed previously. Aging is thought to result in the production of leveller decomposition products which may alter the viscosity of the cathode layer, thus influencing the rate of diffusion of active leveller to the cathode surface.

Levelled zinc electrodeposits may be obtained on the cathode by immersing a cathode and an anode in a zinc plating solution as defined above and passing a suitable current between them. The cathode may be of any metal which is not attacked by the plating bath, notably zinc diecasting, steel, brass, copper and nickel. As is conventional for zinc plating, the anode is generally of zinc, which is dissolved and replenishes the bath as plating proceeds. It is normally convenient to operate at ambient temperature, e.g. 20° to 30° C for normal decorative work, but the solution may be maintained at temperatures of 15° to 40° C. Above 40° C there is danger of acid hydrolysis of the peptone if it is present.

As previously stated, the current density should be in the range of 50 to 1200 A/m$^2$, preferably 100 to 900 A/m$^2$. As a rough guide, 40 minutes plating at 360 A/m$^2$ gives a deposit 25 micrometers thick. Deposits are usually required at a thickness of 12 to 25 micrometers. The coated article is then removed from the zinc plating bath and may be subjected to passivation in the usual way, e.g. by means of a dichromate dip. The coated article may then be used as such, or alternatively subjected to chromium electroplating, for example as described in British Patent Specification No. 1388693.

It is envisaged that concentrates containing the levelling agents will be required as make-up for plating baths during prolonged or continuous plating operation, and such concentrates are encompassed within the scope of the present invention.

The following Examples illustrate the invention:

EXAMPLE 1

| An all chloride bath formulation | |
|---|---|
| $ZnCl_2$ | 30 g/l |
| $NH_4Cl$ | 200 g/l |
| pH | 5.0 |

Deposits from this solution were dull and non-levelling.

The addition of 1 g/l of peptone to the solution produced a semi-bright deposit with a small degree of levelling. A further addition of 1 g/l peptone had no effect. Aging did not appear to improve levelling.

The addition of up to 0.5 g/l of thiourea to the original solution did not produce any significant levelling, either with or without aging.

1 g/l of thiourea and 2 g/l of peptone were added to the original solution. The freshly prepared solution was not levelling. However, after aging 10 hours it was used to obtain 90% levelling at 600 A/m$^2$ on a surface typical of a polished diecasting.

0.26 g/l of thiourea and 0.5 g/l of peptone were added to the original solution. The resulting solution was 80% levelling at 600 A/m$^2$ and 85% levelling at 900 A/m$^2$ using a standard 25 micrometer groove. Aging did not appear to affect the levelling characteristics.

EXAMPLE 2

| A sulphate bath formulation | |
|---|---|
| $ZnSO_4 7 H_2O$ | 160 g/l |
| $ZnCl_2$ (fused) | 20 g/l |
| $B(OH)_3$ | 20 g/l |
| pH | 4.5 |

The deposits obtained from this solution were dull and non-levelled. Addition of peptone (1 g/l) to the base electrolyte produced semi-bright unlevelled deposits. Levelling was observed when 1 g/l thiourea was added to the solution containing 1 g/l peptone. This combined effect of peptone and thiourea on the levelling characteristics of the electrolyte was further investigated.

A high degree of levelling was observed (i.e. 90–100%) with 0.26 g/l peptone and 0.13 g/l thiourea over the current density range 300–900 A/m$^2$. Reduced levelling (i.e. 50–60%) was observed at current densities less than 300 A/m$^2$. Aging of the solution did not improve the levelling characteristic at lower current densities.

An improvement in levelling to 70% was observed at 100 A/m$^2$ when the concentrations of the additives were raised to 0.5 g/l peptone and 0.26 g/l thiourea.

On aging the solution for 10 hours, semi-bright and more levelled deposits were obtained at lower current densities viz. at 100 A/m$^2$. The levelling power at higher current densities remained unaffected.

EXAMPLE 3

This Example illustrates the use of thallium as a levelling agent for zinc plating solutions.

a. The All Chloride Bath Formulation

Deposits from the base electrolyte described in Example 1 were dull and non-levelling. However, highly levelling deposits can be obtained, i.e. of the order 90–100%, when thallous ions are added to the bath. The thallous ion concentration can be varied between 1 mg/l and 10.0 mg/l, and is added to the bath as thallium sulphate dissolved in hot water, optimally 3.5 mg/l.

At thallous ion concentrations below 1 mg/l, the bath remains non-levelling, at concentrations above 10.0 mg/l, the bath becomes "excessively" levelled, raising the levelling power of the electrolyte to above 100%. It is therefore preferred that the thallous ion concentration be maintained between 1.0 mg/l and 10.0 mg/l.

It has been discovered that the thallous ion enhances the brightness of the zinc deposits when used in conjunction with organic compounds.

b. The Acid Sulphate Bath Formulation

The deposits obtained from the base electrolyte described in Example 2 were dull and non-levelled. The levelling power of the electrolyte can be greatly improved i.e. to 90–100%, by adding thallous ions to the baths as thallium sulphate. The concentration of the thallous ions can be varied between 1 mg/l and 10.0 mg/l, optimally 3.0 mg/l. At thallous ion concentrations below 1.0 mg/l the bath remains non-levelling; at thallous ion concentrations above 10.0 mg/l a strong adsorption of thallous ions occurs at the peaks of the projecting points on the cathode greatly reducing the plating rate at these points and making the bath excessively levelling i.e. above 100% levelling.

It has been noted that the thallous ion enhances the brightness of the zinc deposits when used in conjunction with organic compounds.

EXAMPLE 4

The following example describes the use of a bath containing potassium salts:

| | |
|---|---|
| $ZnSO_4 7H_2O$ | 250 g/l |
| K Cl | 25 g/l |
| $B(OH)_3$ | 25 g/l |
| pH | 4.5 |
| Temperature | 25° C |

The levellers 0.5 g/l peptone and 0.25 g/l thiourea were added to the above electrolyte and 90% levelled deposits were obtained at current densities between 10 and 1000 A/m². The most notable feature of the bath in comparison with Example 2 was that operating cell voltages were 30% lower in the presence of potassium chloride.

We claim:

1. A solution for electrodepositing zinc comprising water, zinc ions in a concentration of at least 0.2 M, peptone in a concentration of at least 100 mg/l and thiourea in a concentration of at least 50 mg/l, the weight ratio of peptone to thiourea being from 1:1 to 5:1.

2. A solution according to claim 1 including peptone in a concentration of from 0.2 to 2 g/l and thiourea in a concentration of from 0.1 to 1.0 g/l.

3. A solution according to claim 2 having a pH of from 3 to 6.

4. A solution according to claim 1 wherein the peptone is the product of the peptic digestion of proteins.

5. A solution according to claim 1 wherein the peptone is the product of the tryptic digestion of proteins.

6. A solution according to claim 1 wherein the weight ratio of peptone to thiourea is about 2:1.

7. A solution according to claim 1 including zinc sulphate in a concentration of from 0.2 to 3.0 M, zinc chloride in a concentration of from 10 g/l to 50 g/l, boric acid in a concentration of from 10 g/l to 50 g/l, peptone in a concentration of from 0.2 to 2 g/l and thiourea in a concentration of from 0.1 to 1.0 g/l.

8. A solution according to claim 7 including a potassium salt in a concentration of 0.1 M to 1.5 M.

9. A solution according to claim 8 including a potassium salt in a concentration of 0.25 M to 1.0 M.

10. A solution according to claim 1 including zinc chloride in a concentration of from 0.1 to 2.0 M, ammonium chloride in a concentration of from 1 to 3 M, boric acid in a concentration of from 10 g/l to 30 g/l, peptone in a concentration of from 0.2 to 2 g/l and thiourea in a concentration of from 0.1 to 1.0 g/l.

11. A solution for electrodepositing zinc comprising water, zinc sulphate in a concentration of from 0.2 to 3.0 M, zinc chloride in a concentration of from 10 g/l to 50 g/l, boric acid in a concentration of from 10 g/l to 50 g/l, and thallous ions in a concentration of at least 1 mg/l.

12. A solution according to claim 11 including a potassium salt in a concentration of 0.1 M to 1.5 M.

13. A solution according to claim 12 including a potassium salt in a concentration of 0.25 M to 1.0 M.

14. A solution for electrodepositing zinc comprising water, zinc chloride in a concentration of from 0.1 to 2.0 M, ammonium chloride in a concentration of from 1 to 3 M, boric acid in a concentration of from 10 g/l to 30 g/l, and thallous ions in a concentration of at least 1 mg/l.

15. A chelating agent-free aqueous electrolyte solution for electrodepositing zinc comprising zinc ions in a concentration of at least 0.2 M and thallous ions in a concentration of from 1 mg/l to 10 mg/l.

* * * * *